US005620014A

United States Patent [19]

Milocco et al.

[11] Patent Number: 5,620,014

[45] Date of Patent: Apr. 15, 1997

[54] DISHWASHING MACHINE WITH ELECTRIC HEATING MEANS

[75] Inventors: Claudio Milocco, Trieste; Giovanni Centis, Pordenone, both of Italy

[73] Assignee: Electrolux Zanussi Elettrodomestici S.p.A., Pordenone, Italy

[21] Appl. No.: 581,326

[22] Filed: Dec. 29, 1995

[30] Foreign Application Priority Data

Jan. 9, 1995 [IT] Italy ..... PN95A0004

[51] Int. Cl.[6] ..... A47L 15/42

[52] U.S. Cl. ..... 134/108

[58] Field of Search ..... 134/105, 107, 134/108; 68/15

[56] References Cited

U.S. PATENT DOCUMENTS 2,081,636 5/1937 Minors ..... 134/105 X 2,914,935 12/1959 Sampsel .

3,049,136 8/1962 Van Scoyk ..... 134/108 X 5,129,411 7/1992 Lagerstrand ..... 134/105 X

*Primary Examiner*—Philip R. Coe

*Attorney, Agent, or Firm*—Pearne, Gordon, McCoy & Granger

[57] ABSTRACT

A dishwashing machine includes a water circulation circuit provided with at least one rotating spray arm (6, 7) arranged in a washing tank (3). Water collecting in a sump (5) on the bottom (4) of the tank is supplied to the spray arm through a circulation pump (8). The water is heated up by an electric resistive heating element (11) housed in a casing (10) that is a part of the water circulation circuit (9). The casing (10) is arranged within the washing tank (3) in such a manner that the heating element (11) is in a heat-exchange relationship with the interior of the washing tank and the water collecting in the sump (5) through a surface of the casing.

6 Claims, 2 Drawing Sheets

DISHWASHING MACHINE WITH ELECTRIC HEATING MEANS

BACKGROUND OF THE INVENTION

The present invention refers to a dishwashing machine provided with improved electric means for heating up the working medium.

Traditionally, dishwashing machines have been known to include an electric resistance-type heating element for heating the water to be sprayed onto the washload items and possibly also heating the air to dry the same washload items at the end of the wash cycle.

In traditional solutions, as described for instance in the Italian Utility Model Application No. 34093 B/90 filed on Dec. 13, 1990, the heating element is of the sheathed type for submerged applications and is arranged in the washing tank of the machine, in correspondence of the bottom of said tank. The heating element is wetted by the water and flooded by the water which, after having been sprayed onto the washload items, falls back by gravity onto the bottom of the tank.

In all such solutions, the heat exchange effect between the heating element itself and the wash water is not ideal.

Furthermore, since the heating element is substantially exposed inside the wash tank, it undesirably produces bad odors and can be undesirably hot to a user who opens the door of the dishwashing machine as soon as the final hot-air drying phase is terminated.

In view of substantially eliminating such drawbacks, dishwashing machines have therefore been proposed that make use of so-called "ducted" heating elements, described for instance in U.S. Pat. No. 2,914,935. In such dishwashing machines, the heating element is housed in a hermetically sealed casing which is a part of the water recirculation circuit and is arranged outside the washing tank. As a result, "ducted" heating elements are difficult to access for maintenance or replacement purposes and, in any case, are not able to perform conventional final hot-air drying of the washload items. To be able to perform a final hot-air drying of the washload items to any effective extent, these dishwashing machines must be provided with special condenser-type, or ventilation type, drying arrangements, which considerably and undesirably add to the complexity of the overall construction of the dishwashing machine.

SUMMARY OF THE INVENTION

It is, therefore, a purpose of the present invention to eliminate all such drawbacks as mentioned above.

In particular, it is a purpose of the present invention to provide a dishwashing machine with simple electric heating means that are capable of effectively heating up the working medium of the machine for performing both the washing action and the final hot-air drying of the washload items.

It is a further purpose of the present invention to provide a dishwashing machine of the above-specified kind wherein the heating means are conveniently accessible to maintenance and replacement purposes.

According to the invention, these aims are reached in a dishwashing machine provided with electric heating means and embodying the characteristics as recited in the appended claims.

BRIEF DESCRIPTION OF THE DRAWINGS

The characteristics and the advantages of the present invention will be understood from the description which is given below by way of non-limiting example with reference to the accompanying drawings, in which.

DETAILED DESCRIPTION OF THE PREFERRED EMBODIMENTS

Figure 1:
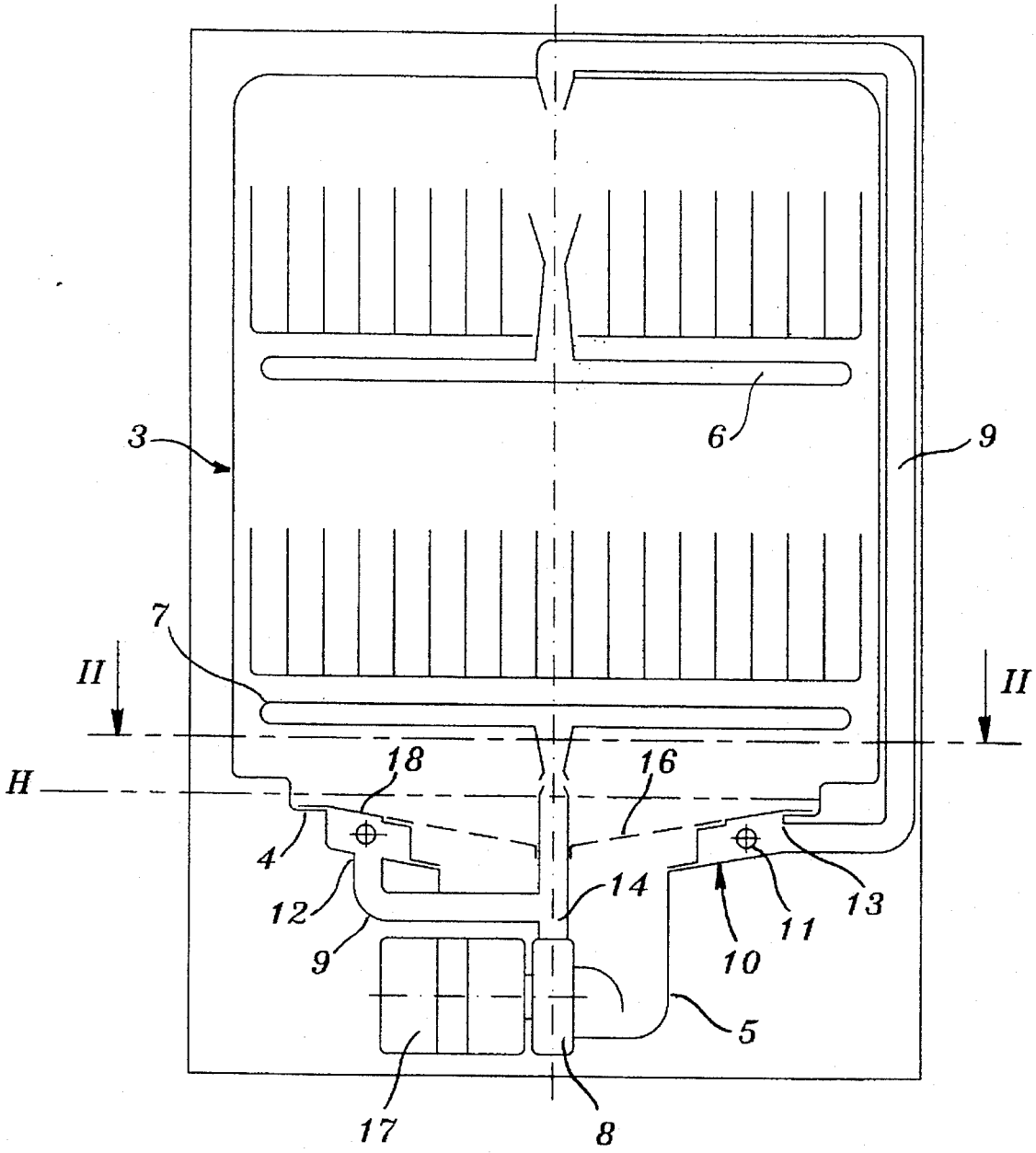
FIG. 1 is a schematical view of a dishwashing machine according to a preferred embodiment of the present invention.
Figure 2:
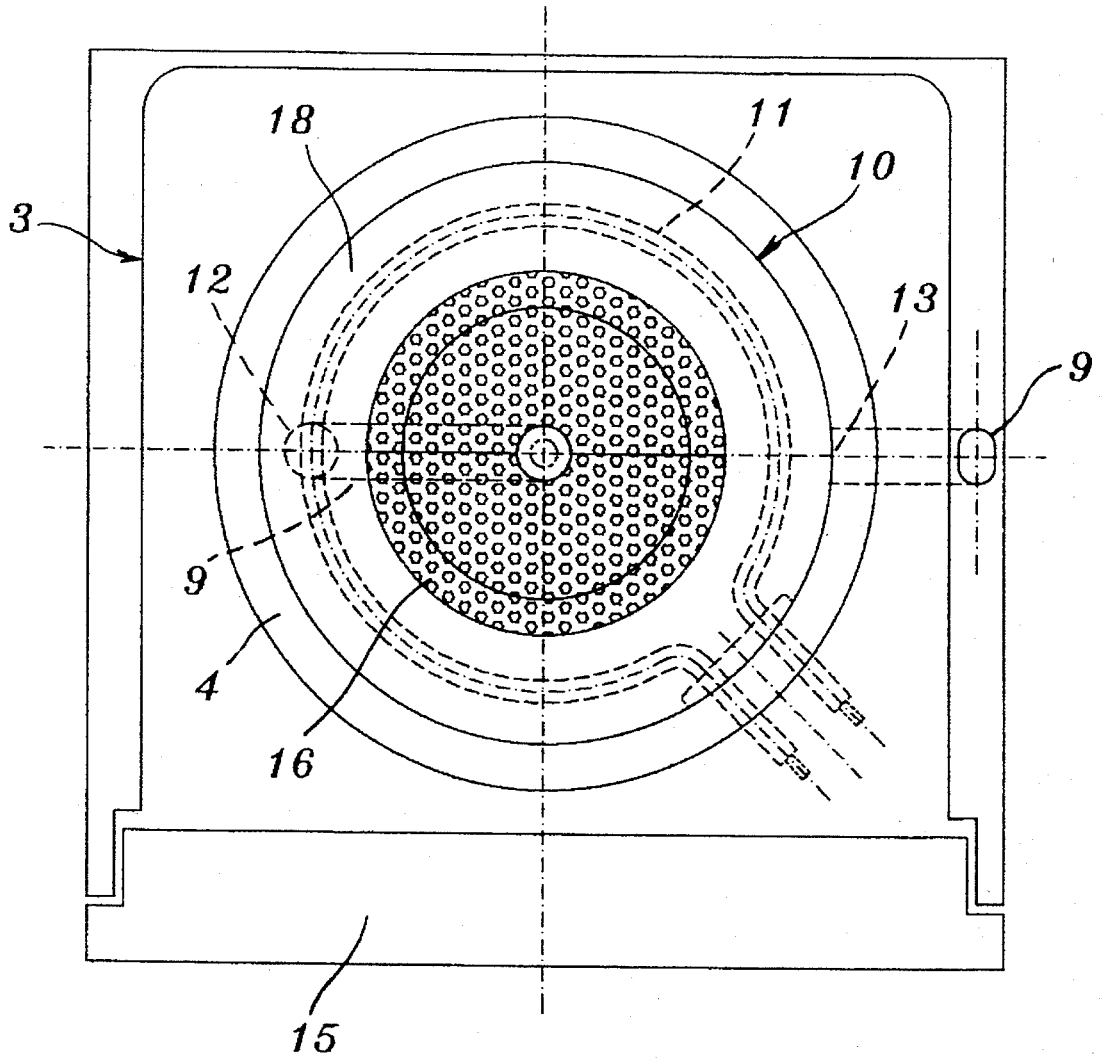
FIG. 2 is a schematical view of the dishwashing machine taken in section along line II—II of FIG. 1.

With reference to the Figures, the water circulation of the dishwashing machine includes a washing tank 3, which is accessible through a door 15 and is provided with a bottom 4 having a lower portion defining a water collection sump 5. In a known manner, the washing tank is preferably arranged to accommodate an upper rotating spray arm 6 and a lower rotating spray arm 7. The spray arms which are adapted to be supplied by a recirculation pump 8 so as to be able to spray, against washload items (not shown), water that then falls back by gravity onto the bottom 4 of the tank and finally collects into the sump 5 through a filter 16. More precisely, at least one of said rotating spray arms (preferably the upper spray arm 6) is connected to a delivery side 14 of the pump 8 through a conduit 9. A substantially sealed casing 10, preferably made of metal, is connected in series with the conduit 9. In a preferred manner, the lower rotating spray arm is connected directly with the delivery side 14 of the pump 8 through a traditional rotary hydraulic joint.

The casing 10, which does not necessarily require a hermetically sealed construction, houses electric heating means, such as a resistance-type heating element 11. The heating element is controlled by a program sequence control switch of the machine so as to heat the water flowing through the casing 10.

According to the present invention, the casing 10 is arranged inside the washing tank 3 in such a manner that, through at least a part of its surface, the heating element 11 is in a heat-exchange relationship with the inside of the washing tank and the water that falls back and collects into the sump 5.

In a preferred manner, the casing 10 is situated at the bottom 4 of the washing tank and has a substantially annular form arranged horizontally. An inlet 12 and an outlet 13 preferably are diametrically opposed to each other and are connected., as already mentioned above, with respective sections of the conduit 9 of the water circulation circuit of the machine. The heating element 11 is correspondingly annularly shaped, with a structure extending through a curve of almost 360° inside the casing 10, so as to optimize the heat-exchange effect.

During operation of the machine, water under pressure is circulated from the delivery side 14 of the pump 8 along the conduit 9 and through the casing 10 so as to eventually supply the upper rotating spray arm 6. In the example being considered, the water flows into the casing 10 through the inlet 12 thereof, from which the water then branches off into two parallel and angularly opposing flows moving toward the outlet 13. In a known manner, the water circulating inside the casing 10 is heated up directly by the heating element 11.

The delivery side 14 of the pump 8 is adapted to supply the lower rotating spray arm 7 as well. In a known manner, the rotating spray arms 6 and 7 may be supplied either simultaneously or alternatively, as described in U.S. Pat. No. 4,741,353. In any case, the water that is in suspension in the washing tank 3 and that falls back by gravity onto the bottom 4 to collect in the sump 5, flows over at least a part 18 of the outer surface of the casing 10, so that, through the casing 10, the heating element 11 is capable of heating up the water also indirectly.

As a result, in the case that the rotating spray arms 6, 7 are supplied simultaneously, the water is heated up by the heating element 11 both directly (inside the casing 10) and indirectly (through the walls of the casing 10).

In the particular case that the rotating spray arms 6, 7 are supplied alternately, the following conditions occur:

when only the upper rotating spray arm 6 is being supplied (through the conduit 9 and the casing 10), the water is heated up by the heating element 11 both directly and indirectly, as described above; and when only the lower rotating spray arm 6 is being supplied, the water that falls down into the sump 5, and thereby flows over the outer surface of the casing 10 is heated up by the heating element 11 indirectly.

In any case, the casing 10 accommodating the heating element 11 is constantly in a condition in which it is being substantially "cooled down" by water and, as a result, meeting industry and government standards.

In this connection, the casing 10 is preferably arranged below a so-called "static" level of the water, that is, the level (indicated generally at H in FIG. 1) that the water reaches in the washing tank 3 when the circulation pump 8 is not operating. This advantageously prevents both the casing 10 and the heating element 11 from possibly getting overheated even under the following irregular operating conditions:

breakdown or failure of the pump 8 and/or the driving motor 17 thereof; or possible prolonged pauses of the pump 8 when the rotating spray arms: 6, 7 are supplied alternately.

From the above description, it can be readily appreciated how a dishwashing machine according to the present invention enables the advantages of the traditional heating element arrangements to be combined with those of the so-called "ducted" heating elements. In particular, the following main advantages are obtained:

(a) optimized heat-exchange effect between the heating means 10, 11 and the water; and (b) the possibility of using a heating element 11 of the "ducted" type also to perform traditional hot-air wash-load drying operations, without any bad smell generation or possible contact with objects due particularly to the fact that the heating element 11 is in a heat-exchange relationship with the inside of the washing tank 3 through the casing 10.

Furthermore, the heating element 11 is conveniently accessible from the inside of the washing tank 3. In this connection, the casing 10 is preferably formed by a correspondingly shaped portion of the bottom 4 of the tank, as well as by a complementary portion 18 which is removably assembled with said bottom portion, for instance by snap fitting or by means of screws. Said complementary portion 18 of the casing 10 may, for instance, form a "cover" that can be readily removed to gain access to the heating element 11. Said cover 18, which is preferably mounted flush with the filter 16, may constitute the portion of surface of the casing 10 which is in a heat-exchange relationship with the inside of the washing tank 3 and the water collecting into the sump 5 over which the water flows.

It will, of course, be appreciated that the above-described dishwashing machine can be subject of a number of modifications without departing from the scope of the present invention.

What is claimed is:

1. A dishwashing machine comprising a washing tank defining a sump in a bottom part of the tank; a water circulation circuit; at least one rotating spray arm arranged in the tank and connected in the water circulation circuit; a circulation pump adapted for supplying water collecting in the sump to the spray arm through the water circulation circuit; an electric heater adapted for heating the water; and a substantially sealed casing defining a part of the water circulation circuit and housing the heater, characterized in that the casing (10) is arranged within the washing tank (3) such that the heater (11) is in heat-exchange relationship with an interior of the washing tank and the water collecting in the sump (5) through at least part (18) of a surface of the casing.

2. A dishwashing machine according to claim 1, wherein the water in the tank reaches a static level when the circulation pump is not operating, characterized in that said surface of the casing (10) is situated below said static level (H) of the water.

3. A dishwashing machine according to claim 1, characterized in that said casing (10) is arranged at the bottom (4) of the washing tank (3) .

4. A dishwashing machine according to claim 3, characterized in that said casing (10) is formed by a portion of the bottom (4) of the tank (3) and a complementary portion (18) that is removably assembled therewith.

5. A dishwashing machine according to claim 3, characterized in that said casing (10) has a substantially annular configuration arranged horizontally with an inlet (12) and an outlet (13) connected to said water circulation circuit (9).

6. A dishwashing machine according to claim 5, characterized in that said inlet (12) and said outlet (13) of the casing (10) are provided at substantially diametrically opposed locations.

* * * * *